US007377833B1

(12) United States Patent
Wanzenboeck et al.

(10) Patent No.: US 7,377,833 B1
(45) **Date of Patent: *May 27, 2008**

(54) BRASSIERE CUP

(75) Inventors: Karl Wanzenboeck, Loebersdorf (AT); Gerhard Fildan, Ebenfurth (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/716,528

(22) Filed: Mar. 9, 2007

(51) Int. Cl.
*A41C 3/10* (2006.01)
*A41C 3/12* (2006.01)

(52) U.S. Cl. ..... 450/54; 450/41; 450/43

(58) Field of Classification Search ..... 450/41, 450/43, 45–56; 2/251–253
See application file for complete search history.

(56) References Cited

U.S. PATENT DOCUMENTS 2,595,088 A * 4/1952 Licht ..... 450/52
3,562,802 A * 2/1971 Avis ..... 450/52
6,346,028 B1 * 2/2002 Fildan et al. ..... 450/41
6,447,365 B1 * 9/2002 Powell et al. ..... 450/41
7,234,994 B2 * 6/2007 Fildan et al. ..... 450/41

* cited by examiner

*Primary Examiner*—Gloria M. Hale
(74) *Attorney, Agent, or Firm*—Andrew Wilford

(57) ABSTRACT

A brassiere cup has inner and outer geometrically similar cup parts fitting in each other and having confronting inner faces and outer faces directed away from each other. The inner faces are formed with aligned and confronting grooves holding a pair of hard plastic wires imbedded in a flexible plastic body completely surrounding and bonded to the wires and formed with a flexible lip. The lip extends from the grooves between the inner faces. Bonds between the inner faces and the flexible plastic body unitarily secure the cup parts together and to the flexible plastic body in which the wires are imbedded.

11 Claims, 3 Drawing Sheets

BRASSIERE CUP

FIELD OF THE INVENTION

The present invention relates to a brassiere. More particularly this invention concerns a cup for a brassiere.

BACKGROUND OF THE INVENTION

A standard brassiere has a strap assembly that passes over the shoulders and behind the back of the wearer, and a front pair of cups that fit over the wearer's breasts, that are joined together between the wearer's breasts, and that are connected to the strap assembly so as to hold in place. Each cup is traditionally made of fabric with some sort of stiffening, and is provided with an underwire that fit under the breast against the wearer's chest. The obvious purpose is to hold and support the breasts while providing the wearer with an attractive shape.

As a brassiere is typically worn all day, it must be as comfortable as possible. A major source of discomfort is the normally hard underwire that can, with time, shift so as to poke the wearer, ride up, or otherwise move to be quite uncomfortable.

In copending application Ser. No. 11/546,944 filed 12 Oct. 2006 we disclose a brassiere that has a pair of cups each provided with a respective underwire assembly. Each such assembly has inner and outer U-shaped hard underwire portions extending substantially parallel to each other below a respective cup of the brassiere, joined together at ends, and separated by an arcuate slot between the ends. The underwire formed by the two portions has a shaped that, in an unstressed or relaxed condition, is arcuately concave in a first upward direction so as to conform to the contour of a breast in the cup, and is also arcuately concave in a second horizontal direction transverse to the first direction so as to conform to the contour of the chest of a wearer of the brassiere. The underwire is embedded in a soft plastic body having an apron along a concave side of the body lying at an angle to the hard underwire portions so that the body and the underwire form a pocket receiving a breast of the wearer in the cup.

Thus according to this earlier invention the underwire has two separate curvatures, each generally determined by one of the two sizes—back and cup—of the brassiere to which it is applied. Thus the underwire for an A cup will have a much smaller radius of curvature for its upward or first curvature than for a D cup, and similarly an underwire for a size-40 brassiere will have a larger radius of curvature of for its rearward or second curvature than for a size-34 brassiere. The result is an underwire that sits flatly against the user without deformation, unlike the prior-art systems there the underwire is planar and must deform to fit against the wearer's chest so that it bears with greater pressure in the center than at the ends.

Such an assembly is a substantial improvement over the single underwire of the prior art. Nonetheless, it is relatively complex to integrate it into a cup liner.

OBJECTS OF THE INVENTION

It is therefore an object of the present invention to provide an improved brassiere cup liner.

Another object is the provision of such an improved brassier cup liner that overcomes the above-given disadvantages, in particular that is which can use the above-described dual underwire assembly and that can be assembled in a liner so as to be stable, comfortable, and inexpensive to manufacture.

SUMMARY OF THE INVENTION

A brassiere cup has according to the invention inner and outer geometrically similar cup parts fitting in each other and having confronting inner faces and outer faces directed away from each other. The inner faces are formed with aligned and confronting grooves holding a pair of hard plastic wires imbedded in a flexible plastic body completely surrounding and bonded to the wires and formed with a flexible lip. The lip extends from the grooves between the inner faces. Bonds between the inner faces and the flexible plastic body unitarily secure the cup parts together and to the flexible plastic body in which the wires are imbedded.

Such a cup is completely smooth and seamless, inside and out. The wire is not perceptible, but provides the necessary stiffening function. Since it is imbedded between the inner and outer parts of the cup and bonded to both of them, there is no possibility of the wire working free and poking the wearer.

The cup parts according to the invention each have a layer of foam forming the respective inner face and formed with the respective groove. The foam is normally breathable, although a nonbreathing closed-cell foam could be used. Furthermore at least one of the cup parts has a textile layer forming the respective outer face, typically of Goretex™. In a preferred embodiment the inner cup part has the textile layer and the textile layer is absorbent. It is also within the scope of the invention to provide a layer of absorbent fabric bonded to and lying between the inner faces.

The plastic wires are reinforced by glass beads and fibers, and in some models may have a metallic core. Furthermore both of the plastic wires are of similar shape and are joined together by integral transverse webs as described in the above-cited copending patent application. The lip extends radially from one of the wires and underlies the cup and is formed with throughgoing vent holes.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
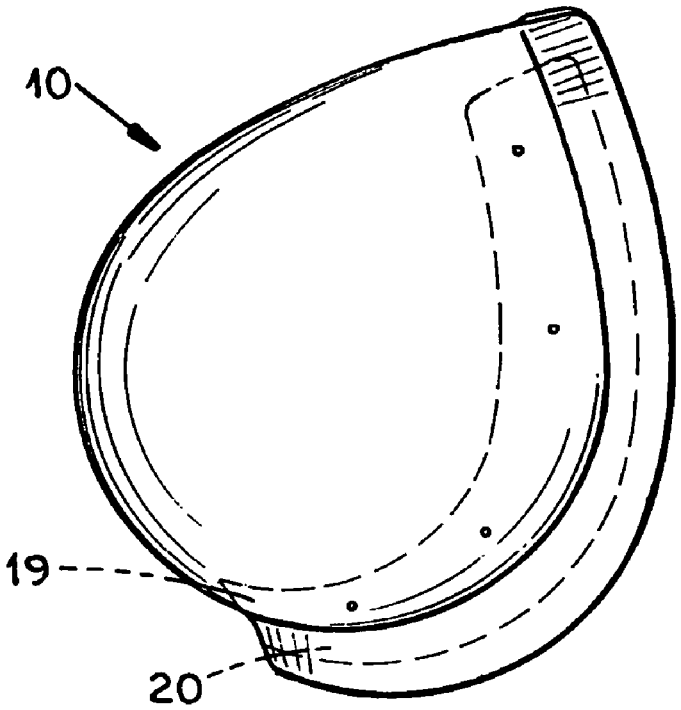
FIG. 1 is a perspective view of the brassiere cup according to the invention.
Figure 2:
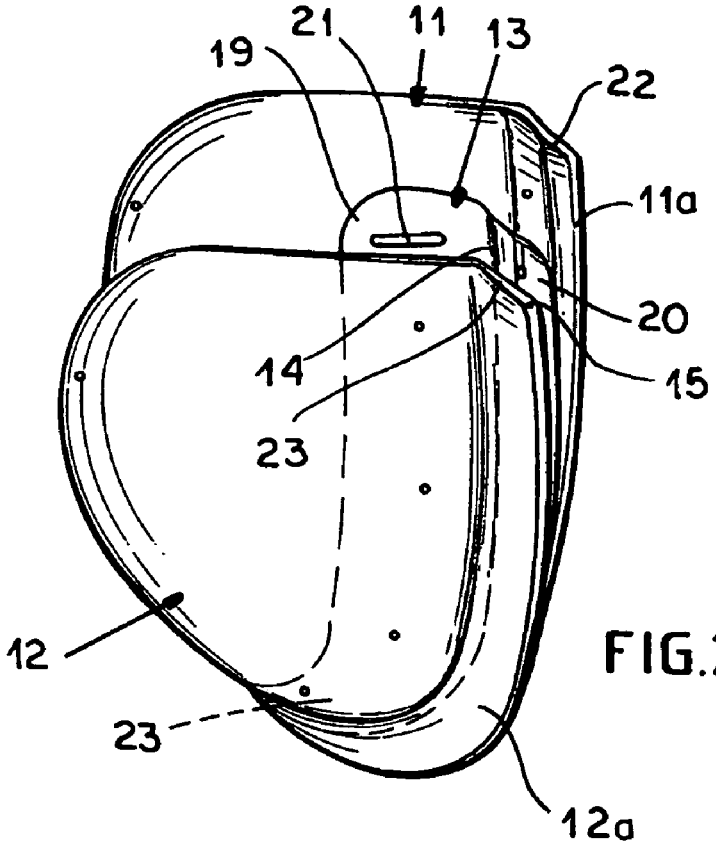
FIG. 2 is a perspective view of the cup with its parts shown in an exploded view.
Figure 3:
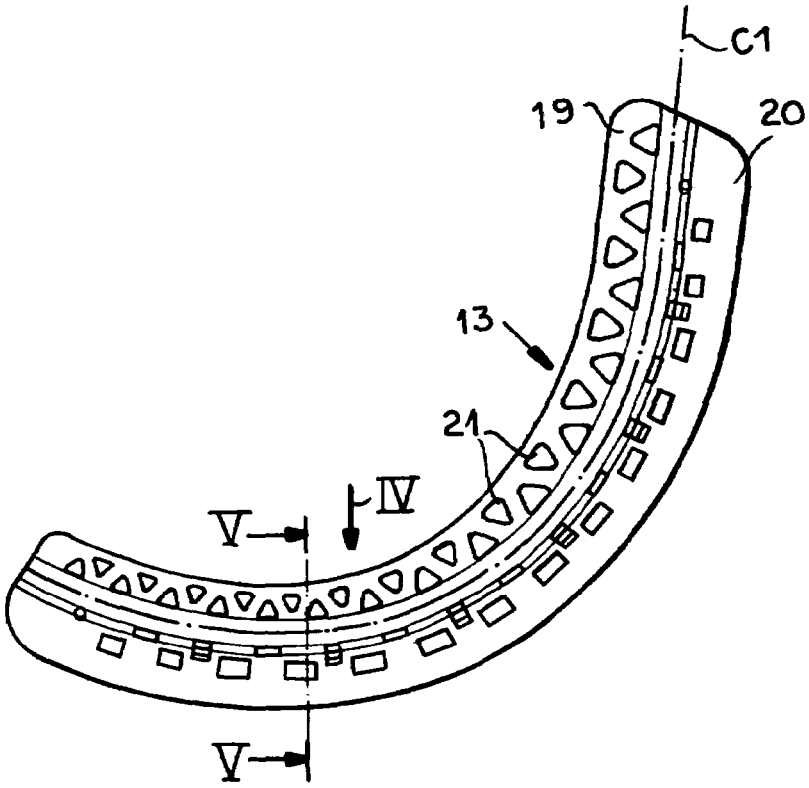
FIG. 3 is a front view of the underwire assembly according to the invention.
Figure 5:
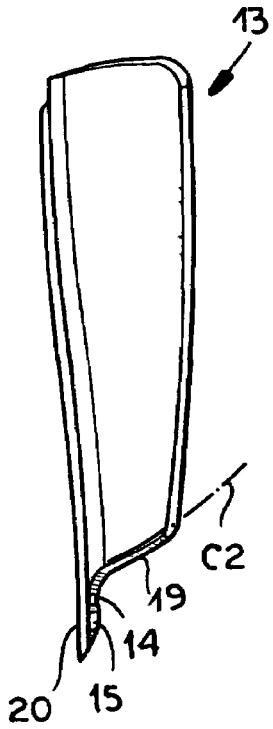
FIG. 5 is a horizontal section taken along line V-V FIG. 3.
Figure 4:
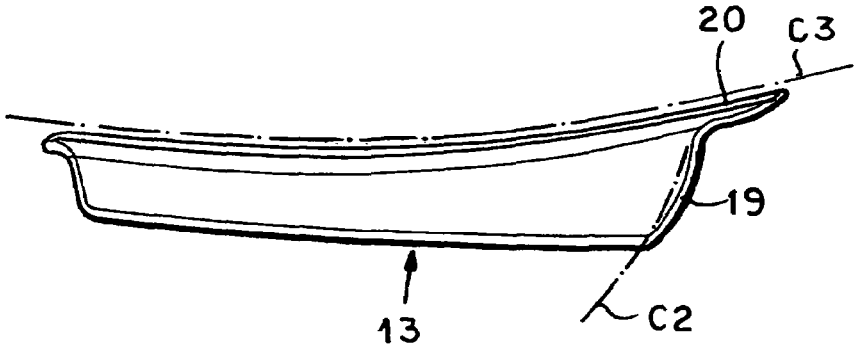
FIG. 4 is a top view taken in the direction of arrows IV of FIG. 3 of the assembly.

As seen in FIGS. 1 and 2 a brassiere cup 10 according to the invention is basically formed of an inner part 11, an outer part 12, and an underwire assembly 13. The parts 11 and 12 are both cup-shaped and formed of a molded plastic, for instance an open-cell foam and have inner faces confronting and engaging each other and outer faces directed away from each other. They each taper from bottom to top, from a thickness at the lower edge of about 3 mm to about 1 mm at the top edge. In addition either or both of the parts 11 and 12 is made partly of a breathable foam and may have a textile layer, for instance of Goretex™. The parts 11 and 12 have flanges 11*a* and 12*a* that flank a lip or flange 20 of the underwire assembly 13 and that as described below normally lie against the chest of the wearer of a brassiere incorporating the cup 10.

The underwire assembly 13 as shown in FIGS. 3-7 comprises a pair of parallel arcuate plastic wires 14 and 15 formed of a relatively hard plastic, e.g. polyamide-6,6 or nylon 6,6, with a row of small integral webs 16 extending across an arcuate slot 17 between the wires 14 and 15 and bridging them. As described in the above-identified patent application, the outer wire 15 can be formed with successive regions of alternatingly lesser and greater thickness so that steps are formed between these regions and serve as stops when the underwire is embedded, preventing it from shifting.

The underwire assembly 13 of the swing-wire type further includes a plastic, e.g. polyurethane, body 18 that is substantially softer and more flexible than the wires 14 and 15 but substantially stiffer and harder than the cup parts 11 and 12. This body 18 is bonded integrally to the plastic wires 14 and 15 and has a lip or flange 19 that extends out from the wires 14 and 16 in between the cup parts 11 and 12 and that normally underlies a breast received in the cup 10 and a flange 20 that normally lies against the chest of a wearer of a brassiere incorporating the cup 10. The flange 19 is formed with holes ro slots 21 that ensure bonding of the cup parts 11 to each other through it, further stabilizing the assembly 13. The flanges 19 and 20 both get thinner away from the wire subassembly 15-16.

Figure 7:
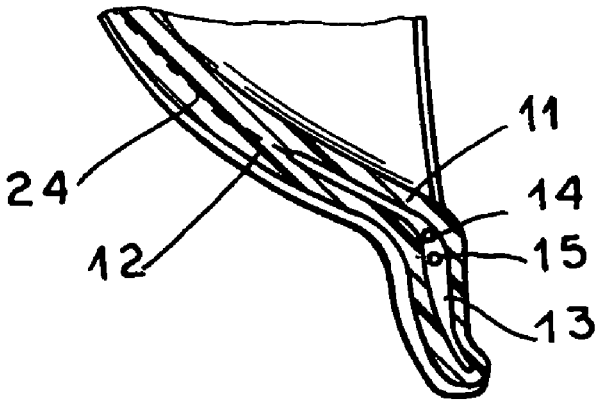
FIG. 7 is a section through the lower edge region of the cup.
Figure 6:
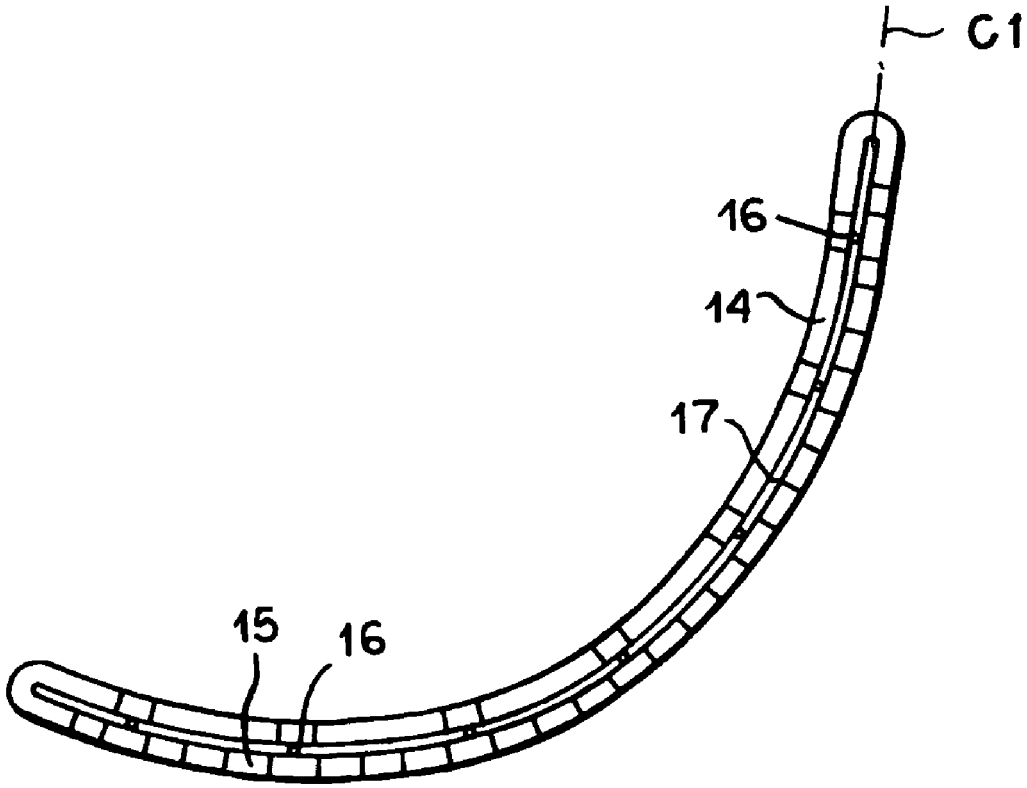
FIG. 6 is a view of the dual-wire subassembly.

In addition the foam inner faces of the cup parts 11 and 12 are formed with confronting grooves 22 and 23 that receive the assembly 13 and are shaped complementarily to it, deeper in the center to accommodate the wire subassembly 15-16 and shallower away therefrom to accommodate the flanges 19 and 20. The entire assembly of the three parts 11, 12, and 13 is assembled and hot pressed together to bond the two parts 11 and 12 to each other and to the assembly 13, forming an integral construction as shown in FIG. 7, with the two cup parts 11 and 12 welded together at 24 to each other and to outer faces of the underwire assembly 13.

According to the invention the assembly 13 has three curvatures C1, C2, and C3. The curvature C1 is concave upward and is dimensioned, that is has a radius, determined by the size of the breast in the respective cup 10. The curvature C2 is in a vertical plane generally perpendicular to the curvature C1 and serves to support and hold the breast in the cup 10. The curvature C3 is concave rearward toward the chest of a wearer of a brassiere incorporating the underwire assembly 13 and is determined by chest size. Hence the underwire assembly sits flatly against the chest of the wearer underneath the breast. The curves C1 and C3 are formed by the hard material of the underwire 13 and the curve C2 by the softer front flange or lip 19. C2 serves to keep C1 in shape, that is to balance or counter the stress on the back wings caused by the weight of the breast. Thus the curvature C1 lies in a generally vertical plane, is open upward, and is determined by the diameter of the breast or cup size. The curvature C2 lies in a generally vertical plane, is open upward, and is generally perpendicular to curvature C1. The curvature C3 lies in a generally horizontal plane, is concave backward toward the wearer of the brassiere, and is determined by the size of the chest or rib cage.

We claim:

1. A brassiere cup comprising:

an inner cup part having a concave and normally rearwardly directed outer face and an opposite, convex, and normally forwardly directed inner face;

an outer cup part having a concave and normally rearwardly directed inner face confronting and fitting with the inner face of the inner cup part and an opposite, convex and normally forwardly directed outer face, the inner faces being formed with aligned and confronting grooves;

a pair of hard plastic wires;

a flexible plastic body sandwiched between the inner faces, completely surrounding and bonded to the wires, and formed with a flexible lip, the wires being fitted to the grooves and the lip extending from the grooves between the inner faces; and bonds between the inner faces and the flexible plastic body unitarily bonding the cup parts together and to the flexible plastic body in which the wires are imbedded.

2. The brassiere cup defined in claim 1 wherein the cup parts each have a layer of foam forming the respective inner face and formed with the respective groove.

3. The brassiere cup defined in claim 2 wherein the foam is breathable.

4. The brassiere cup defined in claim 2 wherein at least one of the cup parts has a textile layer forming the respective outer face.

5. The brassiere cup defined in claim 4 wherein the inner cup part has the textile layer on the respective inner face and the textile layer is absorbent.

6. The brassiere cup defined in claim 1, further comprising a layer of absorbent fabric bonded to and lying between the inner faces.

7. The brassiere cup defined in claim 1 wherein the plastic wires are glass-fiber reinforced.

8. The brassiere cup defined in claim 1 wherein both of the plastic wires are of similar shape and are joined together by integral transverse webs.

9. The brassiere cup defined in claim 1 wherein the lip extends radially from one of the wires and underlies the cup.

10. The brassiere cup defined in claim 1 wherein the lip is formed with throughgoing vent holes.

11. The brassiere cup defined in claim 1 wherein the bonds are welds.

* * * * *